United States Patent [19]

Kroeger et al.

[11] 4,141,540

[45] Feb. 27, 1979

[54] HOT METAL LADLE TILTER

[75] Inventors: William C. Kroeger, Mineral Ridge; Stephen J. Roper, Youngstown, both of Ohio

[73] Assignee: The William B. Pollock Company, Youngstown, Ohio

[21] Appl. No.: 828,828

[22] Filed: Aug. 29, 1977

[51] Int. Cl.[2] ..... F27D 15/00

[52] U.S. Cl. ..... 266/276; 266/228; 266/240

[58] Field of Search ..... 60/403, 406; 308/78; 91/8, 12; 266/228, 240, 276, 278

[56] References Cited

U.S. PATENT DOCUMENTS

| | | | |
|---|---|---|---|
| 1,689,145 | 10/1928 | Lunati | 92/8 |
| 3,445,908 | 5/1969 | Straub | 308/78 |
| 3,524,494 | 8/1970 | Smith | 266/240 |

FOREIGN PATENT DOCUMENTS

| | | | |
|---|---|---|---|
| 1147008 | 4/1963 | Fed. Rep. of Germany | 266/276 |
| 1236737 | 3/1967 | Fed. Rep. of Germany | 266/276 |
| 1271915 | 7/1968 | Fed. Rep. of Germany | 266/276 |
| 1191992 | 10/1959 | France | 266/276 |

*Primary Examiner*—Gerald A. Dost

*Attorney, Agent, or Firm*—Vogel, Dithmar, Stotland, Stratman & Levy

[57] ABSTRACT

A hot metal ladle tilter including a support stand having spaced-apart bearings, a ladle support frame pivotally mounted on the bearings for tilting about a tilt axis, the ladle support frame including two spaced-apart support members for readily receiving thereon a ladle to be tilted, a stop bracket fixedly positioned and engaging the ladle support frame to prevent the tilting thereof rearwardly, the center of gravity of the ladle support frame in combination with the ladle being disposed rearwardly with respect to the tilt axis to urge the ladle support frame against the stop bracket under gravity, an hydraulic motor for pivoting the ladle support frame about the tilt axis, and controls for actuating the hydraulic motor.

15 Claims, 9 Drawing Figures

HOT METAL LADLE TILTER

BACKGROUND OF THE INVENTION

The present invention relates generally to improvements in hot metal ladle tilters, and specifically to the provision of a ladle tilter which can readily removably receive a ladle of hot metal thereon from an overhead crane, and thereafter tilt the ladle under positive control to a predetermined angle for skimming of slag from the surface of the metal thereof while the overhead crane is used for other purposes.

In one steel making process, molten blast furnace iron is charged into a ladle supported on an overhead crane. Also charged into the ladle is a quantity of molten slag that serves as an insulation during the transporting of the molten iron from the blast furnace to the next steel making step, typically a basic oxygen furnace. Prior to charging the molten iron into the basic oxygen furnace, the molten slag must be removed from the surface of the molten iron so as not to interfere with the conversion process.

The normal procedure heretofore has been to hold the ladle with the molten iron and slag therein with an overhead crane at the proper angle adjacent to a hydraulic skimming device. The hydraulic skimming device has an arm carrying on the outer end thereof a blade shaped like the common garden hoe which is used to scrape the slag from the surface of the molten metal onto the underlying floor or into a slag pot disposed therebelow. The disadvantages of this procedure are that the overhead crane is tied up and prevented from being used in more economically useful activity, and the control of the tilting of the ladle is not very good whereby the ladle may not be positioned in the proper angle for effective removal of the molten slag therefrom.

Typical prior systems utilizing overhead cranes to hold ladles of molten metal and effect tilting thereof are illustrated in the following U.S. Pat. Nos.: 2,224,906, granted Dec. 17, 1940 to W. S. Fraula; 2,881,488 granted Apr. 14, 1959 to F. M. Schweinberg; 2,987,786 granted June 13, 1961 to F. T. Smith et al.; 3,111,228 granted Nov. 19, 1963 to R. P. Anderson, 3,314,550 granted Apr. 18, 1967 to R. B. McCready et al.; and 3,874,514 granted Apr. 1, 1975 to R. Wilson. All of these prior art patented systems tie up the overhead crane while the ladle of molten metal is tilted and the slag removed from the surface of the molten metal.

Certain prior systems dealing with ladles of molten metal do not utilize overhead cranes whatsoever, but permanently mount the ladle on a tilting mechanism. Examples of such prior art systems are illustrated in the following U.S. Pat. Nos.: 3,693,960 granted Sept. 26, 1972 to K. H. Golde et al.; and 3,784,178 granted Jan. 8, 1974 to M. Wernli. Neither of these prior art patents show the concept of utilizing an overhead frame to deposit a readily movable ladle temporarily upon a ladle tilter for removal of slag from the surface of the molten metal therein.

SUMMARY OF THE INVENTION

The present invention provides a hot metal ladle tilter that receives a ladle of hot metal from an overhead crane, thus relieving the overhead crane for more economic uses, the ladle tilter tilting the ladle to a desired angle for removal of molten slag from the surface of hot metal therein, and the ladle thereafter being retrieved by an overhead crane for transport to the next metal processing station.

This is accomplished in the present invention, and it is an object of the present invention to accomplish these desired results, by providing a hot metal ladle tilter for controlled tilting of a ladle with a pouring spout and having trunnions extending laterally therefrom on either side of the pouring spout and two support brackets respectively disposed thereon adjacent to the trunnions and an abutment bracket disposed thereon between the pouring spout and the axis of the trunnions, the tilter comprising a support stand having spaced-apart bearings thereon defining a generally horizontal tilt axis, a ladle support frame pivotally mounted on the bearings on the support stand for tilting about the tilt axis, the ladle support frame including two spaced-apart members for readily removably receiving thereon respectively the support brackets for the ladle to be tilted and including an abutment member for engaging the abutment bracket on a ladle to be tilted, and a motor for tilting the ladle support frame with a ladle of hot metal thereon about the tilt axis to lower the pouring spout of the ladle to a predetermined point to permit skimming of the slag from the surface of the hot metal in the ladle.

Another object of the invention is to provide hot metal ladle tilter of the type set forth and further comprising a stop bracket fixedly positioned with respect to the support stand and engaging the ladle support frame when in the ladle receiving position thereof and positively preventing tilting of the ladle support frame and the ladle thereon in a direction rearwardly and away from the pouring spout on the associated ladle, the center of gravity of the ladle support frame and of the combination of the ladle support frame with the ladle thereon being disposed rearwardly with respect to the tilt axis so that the ladle support frame is urged against the stop bracket by gravity.

Yet another object of the invention is to provide a hot metal ladle tilter of the type set forth, wherein the motor is a hydraulic motor having one end pivotably mounted at a fixed point spaced from the ladle support frame and the other end pivotably mounted on the ladle support frame at a point offset from the tilt axis, and control means for actuating the hydraulic motor to tilt the ladle support frame with the ladle of hot metal thereon about the tilt axis and away from the stop bracket to lower the pouring spout of the ladle to a predetermined point to permit skimming of the slag from the surface of the hot metal in the ladle.

Further features of the invention pertain to the particular arrangement of the parts of the hot metal ladle tilter, whereby the above outlined and additional operating features thereof are attained.

The invention, both as to its organization and method of operation, together with further features and advantages thereof will best be understood with reference to the following specification taken in connection with the accompanying drawings.

DESCRIPTION OF THE PREFERRED EMBODIMENT

Figure 1:
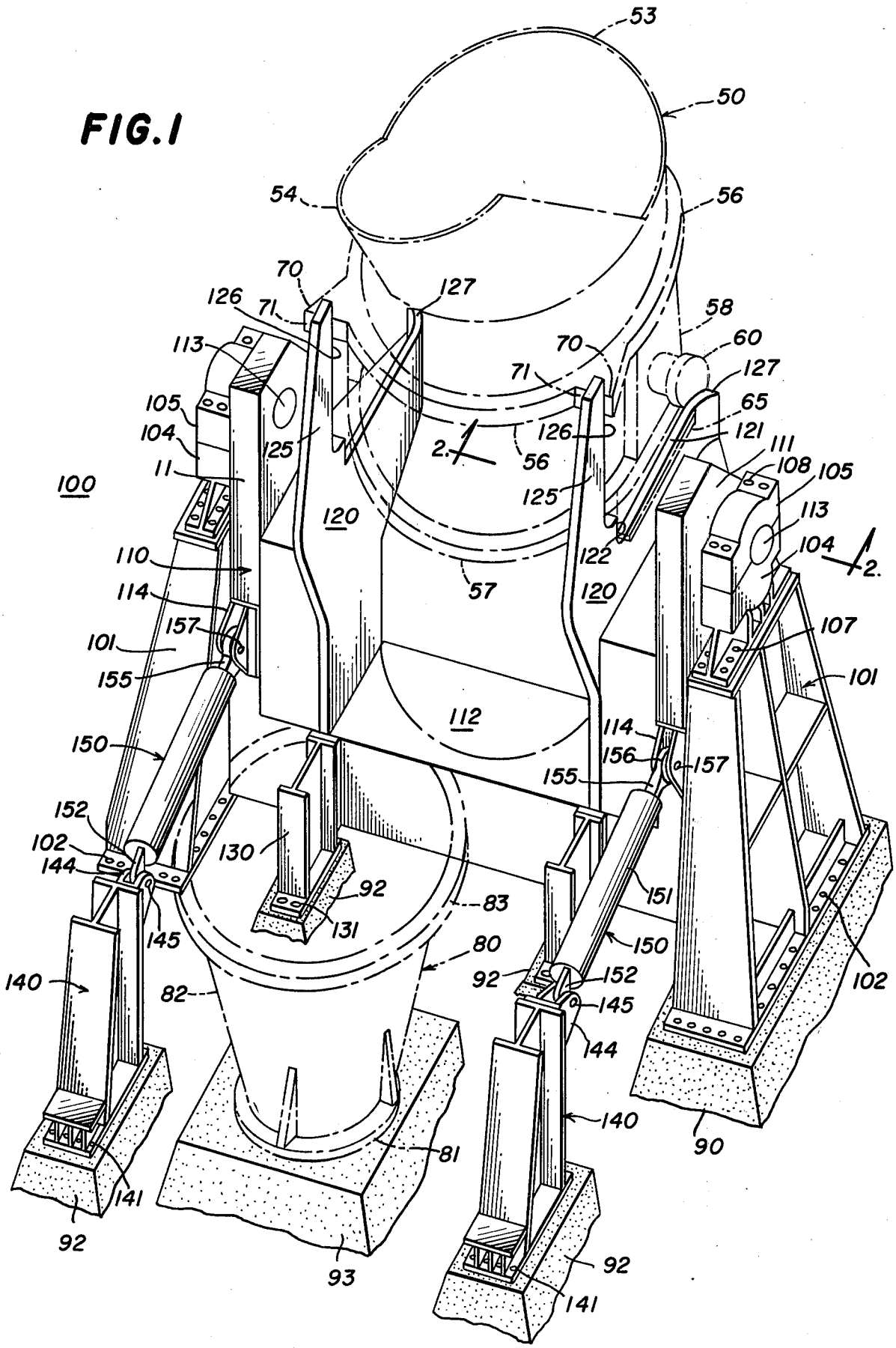
FIG. 1 is a perspective view of the preferred embodiment of a hot metal ladle tilter made in accordance with and embodying the principles of the present invention, a ladle being shown thereon in dashed lines and a slag pot also being shown therein in dashed lines.

Referring to FIG. 1 of the drawings, there is shown a ladle tilter 100 made in accordance with and embodying the principles of the present invention. The ladle tilter 100 is adapted to receive from an overhead crane a ladle 50 and thereafter to tilt the ladle 50 forwardly as viewed in FIG. 1 to a position such that the molten slag on the surface of the hot metal within the ladle 50 can be poured into a slag pot 80.

Figure 2:
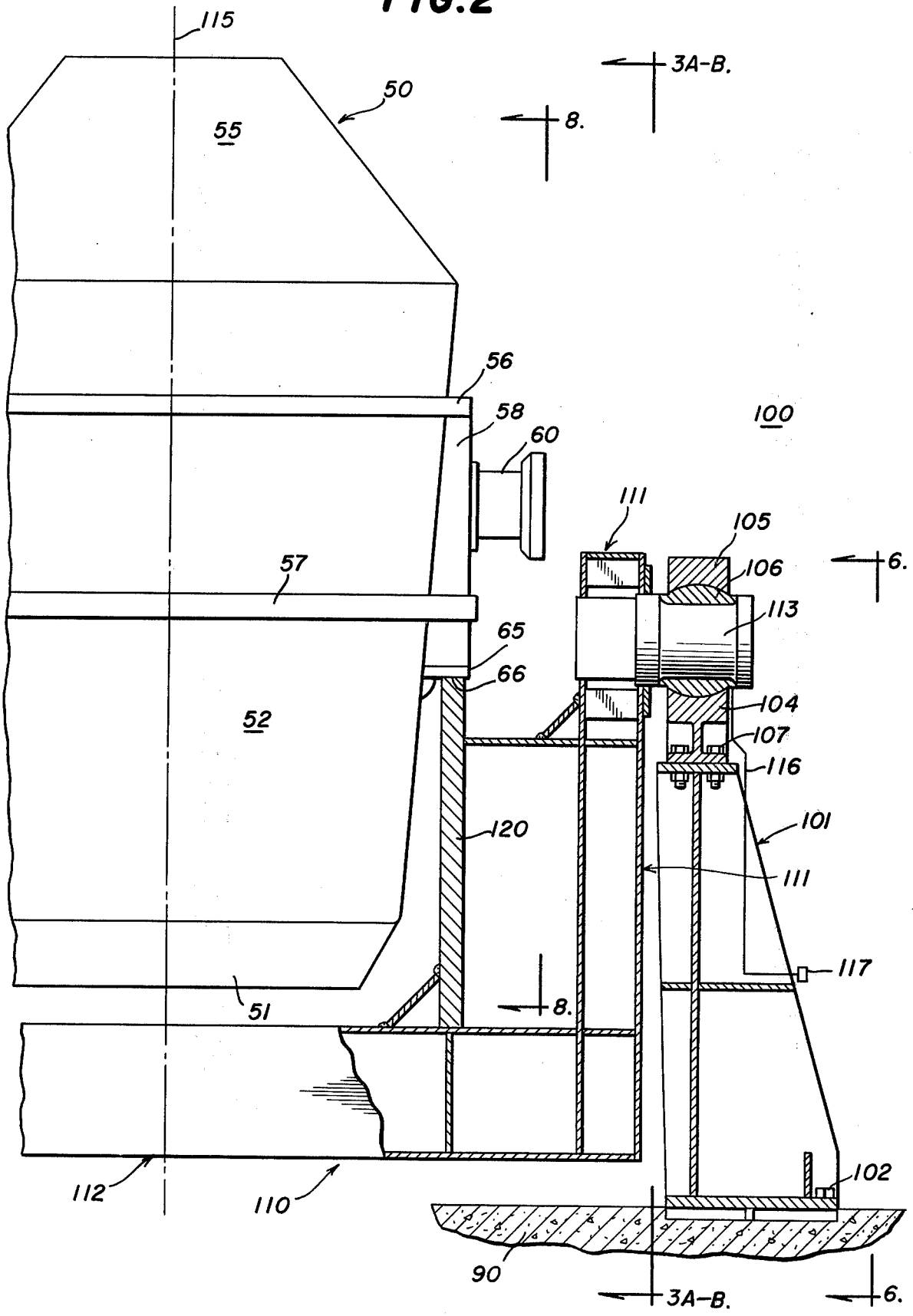
FIG. 2 is a fragmentary view of the ladle tilter of FIG. 1 partly in section as seen along the line 2—2 of FIG. 1.
Figure 8:
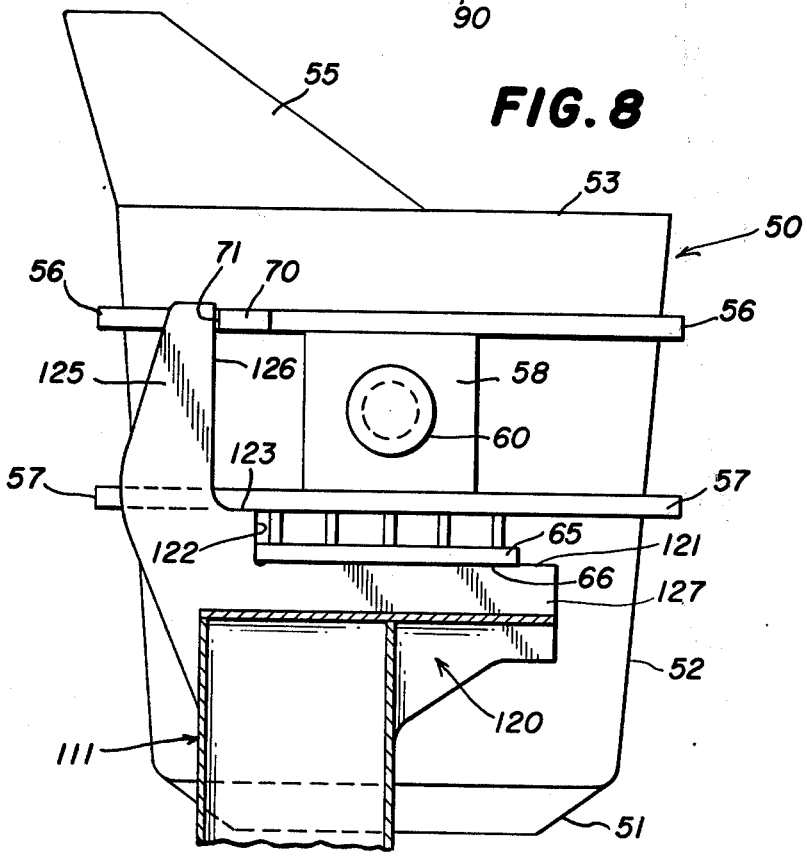
FIG. 8 is a fragmentary view showing the engagement between the ladle support frame of the ladle tilter of FIG. 1 and a ladle supported thereon.

The ladle 50 is best illustrated in FIGS. 2 and 8 of the drawings, wherein it will be seen that there has been provided a bottom wall 51 from which extends upwardly a frusto-conical side wall 52 terminating in a top rim 53. A pouring spout 55 is mounted on one portion of the top rim 53 for the pouring of the contents from the ladle 50. Encircling the side wall 52 is an upper reinforcing ring 56 and a lower reinforcing ring 57, two diametrically opposed mounting plates 58 being mounted on the ladle 50 between the reinforcing rings 56 and 57. Extending outwardly from and fixedly attached with respect to the mounting plates 58 are two trunnions 60 which are used to engage the ladle 50 by hooks from an overhead crane, all in the usual manner.

For the purpose of the present invention, there has been added to the ladle 50 diametrically opposed support brackets 65 disposed below the reinforcing ring 57 and in general vertical alignment with the associated trunnion 60, each support bracket 65 having a lower support surface 66 that rests upon the ladle tilter 100 as will be explained more fully hereinafter. There also is provided on the upper reinforcing ring 56 two laterally spaced-apart abutment brackets 70 spaced forwardly with respect to the trunnions 60 and each having forwardly facing abutment surfaces 71 that abut against a cooperating structure on the ladle tilter 100, all as will be explained hereinafter.

The ladle 50 may be, for example, of a size such that its weight plus the weight of the contents when it is full is 275 tons. Such a ladle has an upper diameter of approximately 15 feet and an overall height from the bottom wall 51 to the upper end of the spout 55 of 15 feet. The maximum charge of hot iron into a ladle 50 of this size would be about 510,000 lbs., and a minimum charge would be about 237,000 lbs.

Figure 3A:
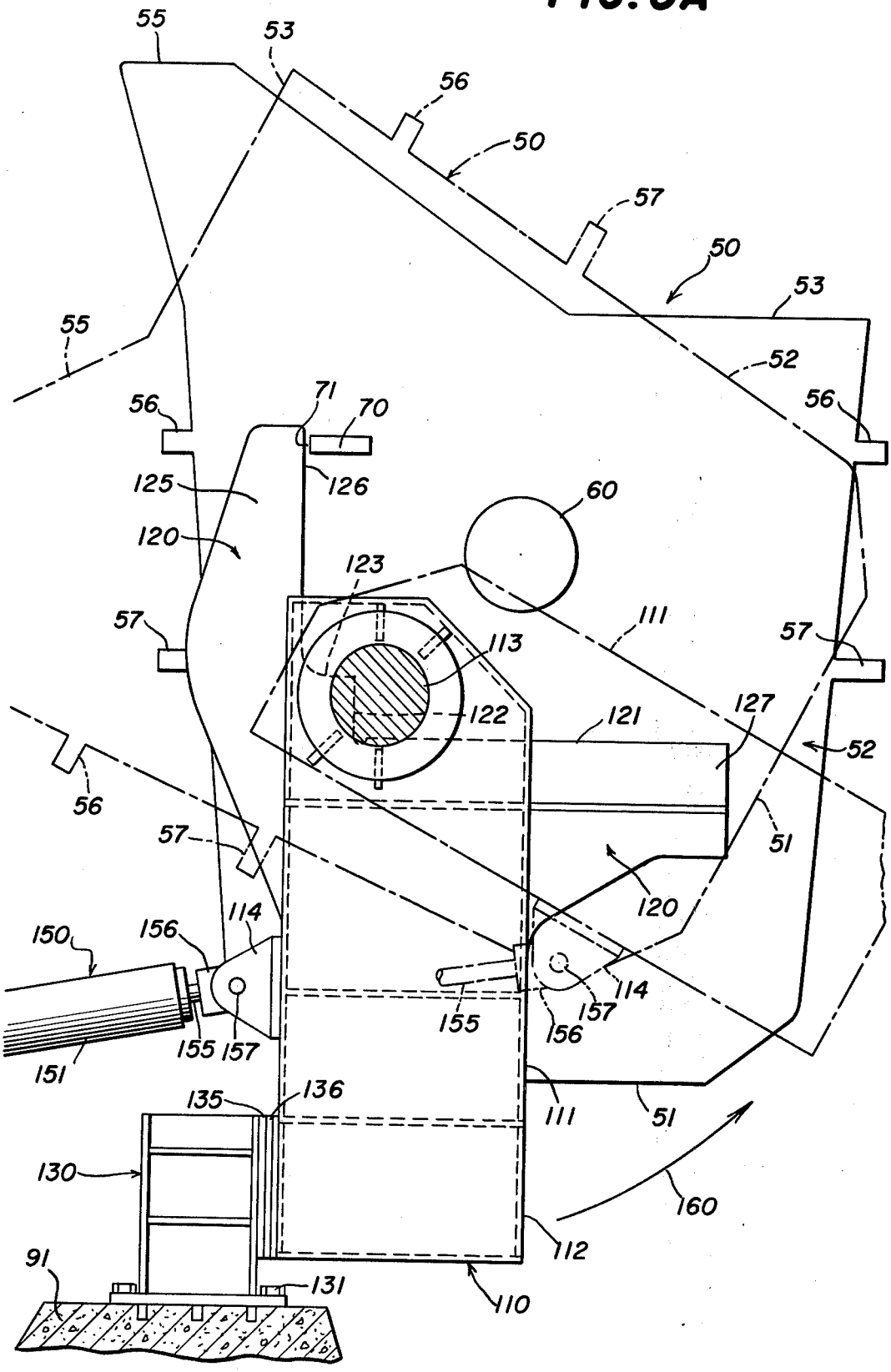
FIGS. 3A and 3B taken together comprise a side elevational view with certain parts broken away illustrating in solid lines the positions of the parts in the ladle receiving position of the ladle tilter, and illustrating in dashed lines the positions of the parts when the ladle has been tilted to the maximum angle for removal of molten slag therefrom.
Figure 3B:
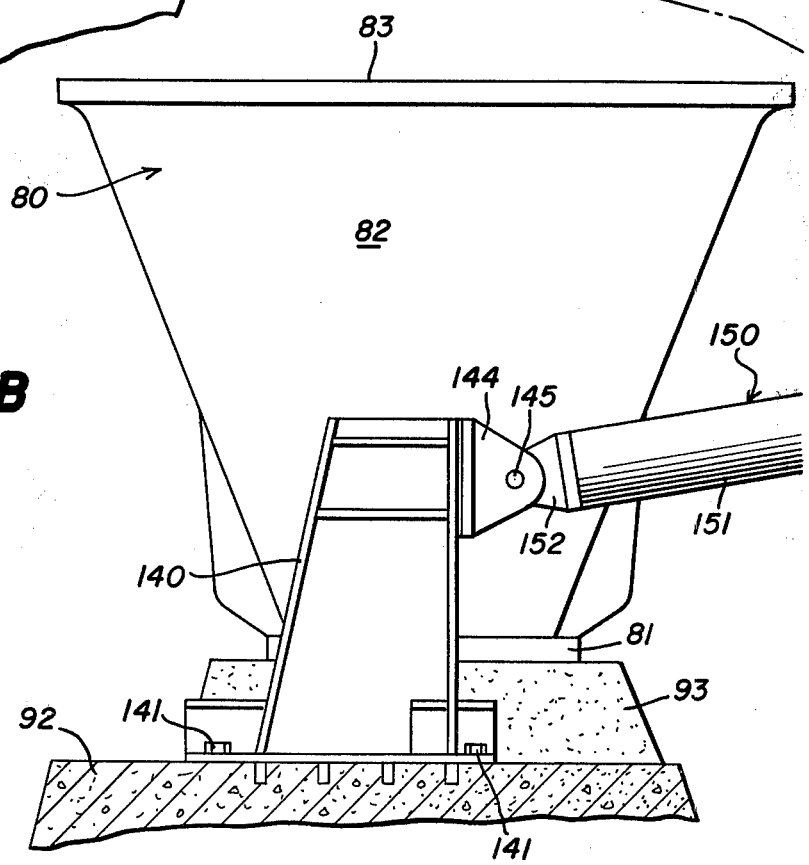

Although the molten slag from the ladle 50 may be poured directly upon the floor, it is preferred to use the slag pot 80 which is best illustrated in FIGS. 1 and 3B. The slag pot 80 includes a circular bottom wall 81 from which extends upwardly a frusto-conical side wall 82 terminating in a rim 83.

As is illustrated in FIG. 1, the ladle tilter 100 comprises two spaced-apart stands 101 that support therebetween a ladle support frame 110 carrying spaced-apart support plates 120 that receive the ladle 50 thereon. Two stops brackets 130 are disposed in front of the ladle support frame 110 to limit the rearward tilting thereof. Spaced forwardly with respect to the stands 101 are two cylinder brackets 140 that provide a fixed mounting for one end respectively of two hydraulic motors 150 that are respectively disposed between the opposite sides of the ladle support frame 110 and the cylinder brackets 140.

Figure 5:
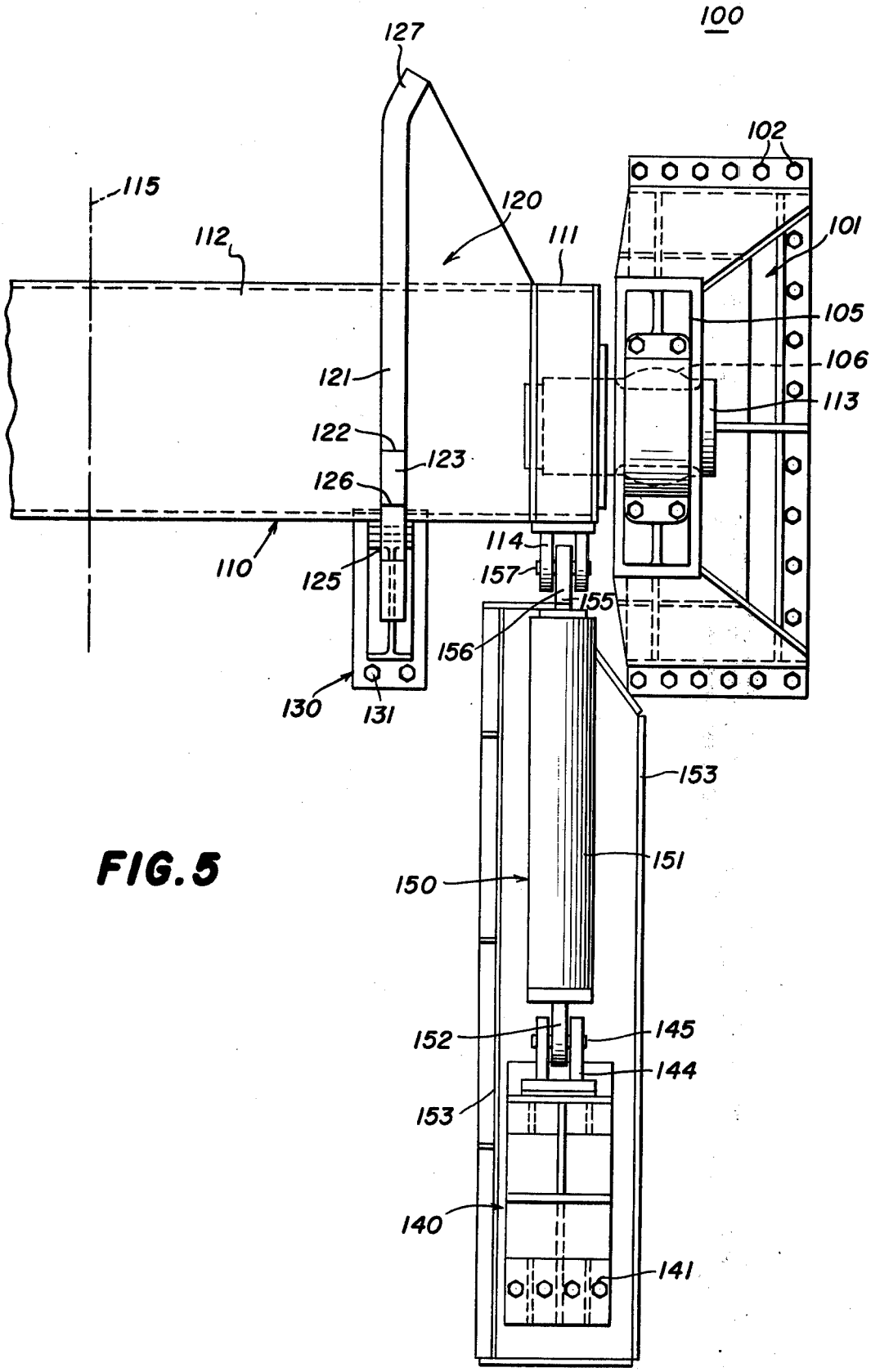
FIG. 5 is a fragmentary plan view of one half of the symmetrical ladle tilter of FIG. 1.
Figure 7:
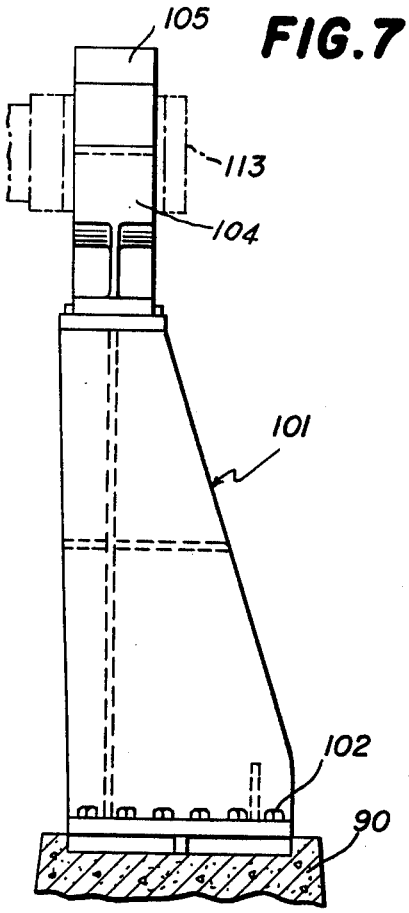
FIG. 7 is a front elevational view of the stand of FIG. 6.
Figure 6:
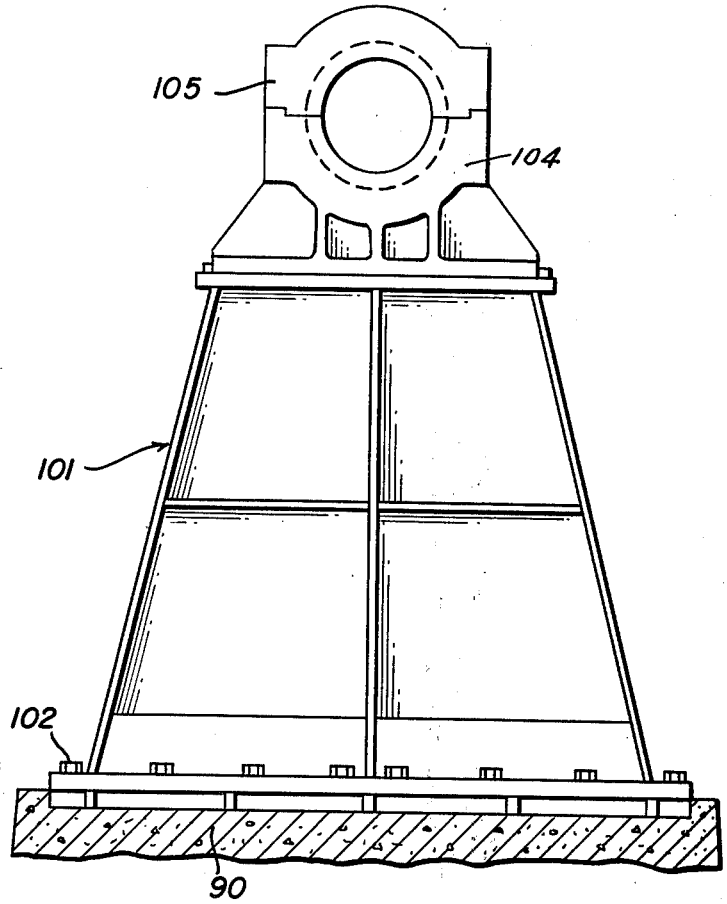
FIG. 6 is a side elevational view of one of the ladle tilter stands forming part of the ladle tilter of FIG. 1.

The stand 101 is further illustrated in FIGS. 5, 6 and 7 of the drawings, wherein it will be seen that each of the stands 101 is mounted upon a foundation block 90, formed preferably of concrete, and fixedly mounted on an underlying support surface. A plurality of bolts 102 firmly secures the bottom of each stand 101 to its associated foundation block 90. Each stand 101 tapers upwardly both in end view and side view as seen respectively in FIGS. 6, and 7, and carries on the upper ends thereof a bearing support 104. Secured to the bearing support 104 is a bearing cover 105 and disposed therebetween is a spherical bearing 106 (see FIG. 2 also). Bolts 107 mount the bearing support 104 on the upper end of the stand 101 while bolts 108 interconnect each bearing support 104 and its associated bearing cover 105.

The bearing stands 101 and the bearing supports 104 thereon are laterally spaced apart to receive therebetween the U-shaped ladle support frame 110. The frame 110 more particularly includes two spaced-apart side members 111 that are connected at the lower ends by a cross member 112 to provide the U-shaped frame. The upper ends of the side members 111 respectively carry stub shafts or trunnions 113 (see FIG. 2 particularly) the stub shafts 113 being journaled in the spherical bearings 106. Also mounted on the front portion of each of the side members 111 is an attachment bracket 114 for connection to the piston rod of the associated hydraulic motor 150, all as will be explained more fully hereinafter. As is best seen in FIG. 2, the ladle support frame 110 is symmetrical about a vertical plane or center line 115 that is normal to the cross member 112 at the center thereof. In order to assure proper lubrication of the spherical bearings 106, a lubrication line 116 is provided therefor as is diagrammatically illustrated in FIG. 2, one end of the line 116 communicating with the associated spherical bearing 106 and the other end being connected to a coupling 117 for attachment to a lubrication system.

Mounted on the inner sides of the side members 111 are two support plates or support members 120 disposed essentially parallel and providing support stands for receiving an associated ladle 50. Each support plate 120 has a generally horizontally arranged support surface 121 (see FIGS. 3A and 8) which extends from the right hand end as viewed in those figures and terminates in an upstanding surface 122. The upper end of the surface 122 joins a second horizontal surface 123 which joins an abutment member or stop block 125 that is integral with and forms a part of the support plate 120. The abutment member 125 has an abutment surface 126 that is disposed rearwardly or to the right as viewed in FIGS. 3A and 8. The rear or right hand ends of the support plates 120 as viewed in FIGS. 1 and 5 are provided with outturned portions or flanges 127 that serve to guide a ladle 50 between the support plates 120 and into mounted position thereon.

As is best seen in FIGS. 2 and 8, the trunnions 60 for the ladle 50 are disposed well above the support brackets 65 disposed respectively on the opposite sides of the ladle 50. The support surfaces 66 on the support brackets 65 are shaped and arranged to rest upon the associated support surfaces 121 on the support plates 120 with the forward edges of the support brackets 65 against the upstanding surfaces 122. The abutment brackets 70 on the ladle 50 are disposed forwardly with respect to the trunnions 60 and in the direction of the pouring spout 55, and the abutment surfaces 71 thereon are initially spaced just a short distance away from the abutment surface 126 on the associated abutment member 125. Due to this construction, it will be seen that an overhead crane carrying the ladle 50 by means of the trunnions 60 can easily and quickly removably position the ladle 50 upon the ladle support frame 110. The outturned flanges 127 on the support plates 120 assist in guiding the ladle onto the ladle support frame 110, and specifically placement of the support surfaces 66 upon the support surfaces 121, the upstanding surfaces 122 and the forward ends of the support brackets 65 positively determining the forward position of the ladle 50 with respect to the support plates 120.

The stop brackets 130 are in the form of upstanding I-beams (see FIGS. 1 and 3A) that are mounted by means of the bolts 131 on foundation blocks 91 preferably formed of concrete and fixedly positioned with respect to the underlying support surface. On the flange of the stop brackets 130 disposed toward the cross member 112 is a sheet of cushioning and insulating material 135 held in place by a plate 136 that abuts against the forward surface of the cross member 112. The stop brackets 130 serve to limit the rearward tilting of the ladle support frame 110 so as to assure that the frame 110 and the ladle 50 thereon will not rotate in clockwise direction as viewed in FIG. 3A, thus to prevent positively the dumping of the contents of the ladle 50 by such reverse tilting. Furthermore, it is pointed out that the center of gravity of the ladle 50 plus its contents lies in a plane passing through the aligned axes of the trunnions 60 and normal to the bottom wall 51, and furthermore is disposed along the horizontal center line of the ladle 50 and below the axis of the trunnions 60. As will be seen in FIG. 3A, the center of gravity therefore lies to the rear or to the right as viewed in FIG. 3A of the pivot axis of the stub shafts 113. Furthermore, the center of gravity of the combined mass represented by the ladle 50, its contents and the ladle support frame 110 also is behind or to the right of the pivot axis of the stub shafts 113. As a consequence, gravity serves to urge the ladle support frame 110 and the material supported thereon in a clockwise direction and against the stop brackets 130.

Tilting of the ladle support frame 110 and the ladle 50 mounted thereon to the proper tilt position is accomplished by means of the two hydraulic motors 150. The two spaced-apart cylinder brackets 140 are provided (see FIGS. 1, 3A and 5) which are generally trapezoidal in form and are each secured by bolts 142 to a foundation block 92. Each of the cylinder brackets 140 has an attachment bracket 144 on the rearward face thereof adjacent to the upper end thereof to support the adjacent rear end of the associated hydraulic motor 150.

Each of the hydraulic motors 150 includes the usual cylinder 151, a piston (not shown) and a piston rod 155 connected to the piston and extending from one end of the cylinder 151. The other end ot the cylinder 151 has a mounting bracket 152 thereon that is secured by means of a pin and spherical bearing 145 to the attachment bracket 144. The other end of the piston rod 155 carries a mounting bracket 156 that is secured to an attachment bracket 114 on the associated side member 111 by means of a pin and spherical bearing 157.

With the hydraulic motors 140 in the fully retracted positions thereof as illustrated by solid lines in FIGS. 3A–3B, the cross member 112 on the ladle support frame 110 is firmly disposed against the stop brackets 130. After placement of a ladle 50 on the ladle support frame 110, the hydraulic motors 150 are actuated to expand, for example, to the dashed line position illustrated in FIGS. 3A–3B, this being the fully extended position of the hydraulic motors 150 and the most forward tilt position for the ladle 50 and the support frame 110. This corresponds to the solid line position of the parts in FIG. 4 and corresponds to the minimum charge of hot metal into the ladle 50, that being about 237,000 lbs. With the parts in this position, the hot metal 72 has a surface 73 that is originally covered by molten slag 74. The molten slag 74 is removed from the surface of the hot and molten metal 72 by an hydraulic skimming device generally designated by the numeral 75. The skimming device 75 includes an elongated arm 76 carrying on the outer end thereof an elongated blade 77, much in the form of the ordinary garden hoe. When the arm 76 is moved in the direction of the arrow 78, the molten slag 74 is scraped from the ladle 50 and falls in a stream in the direction of the arrow 79 and into the slag pot 80 which rests upon a foundation block 93 of concrete or the like supported by an underlying support surface.

In order to place the ladle 50 and the hot molten metal 72 and the slag 74 thereof in the proper tilted position with the minimum charge of 237,000 lbs. of metal therein, the ladle 50 and the associated ladle support frame 110 must be tilted in the direction of the arrow 160 in FIG. 3A to an angle of approximately 60° with respect to the vertical, this being the maximum tilted position. In the tilted position, the combined center of gravity of the ladle 50 plus its metal content 72 and the ladle support frame 110 is still to the rear of a vertical plane through the tilt axis defined by the axes of the trunnions 113. As a result, if there is failure of the hydraulic motors 150 in any respect, and specifically if there is a failure of the electrical supply or hydraulic supply thereto, the ladle 50 and the ladle support frame 110 will be moved by gravity to the upright position illustrated by solid lines in FIG. 3A of the drawings. The rate of return of the ladle 50 and the ladle support frame 110 to the vertical position is controlled by orifice valves (not shown) associated with each of the hydraulic motors 150.

Figure 4:
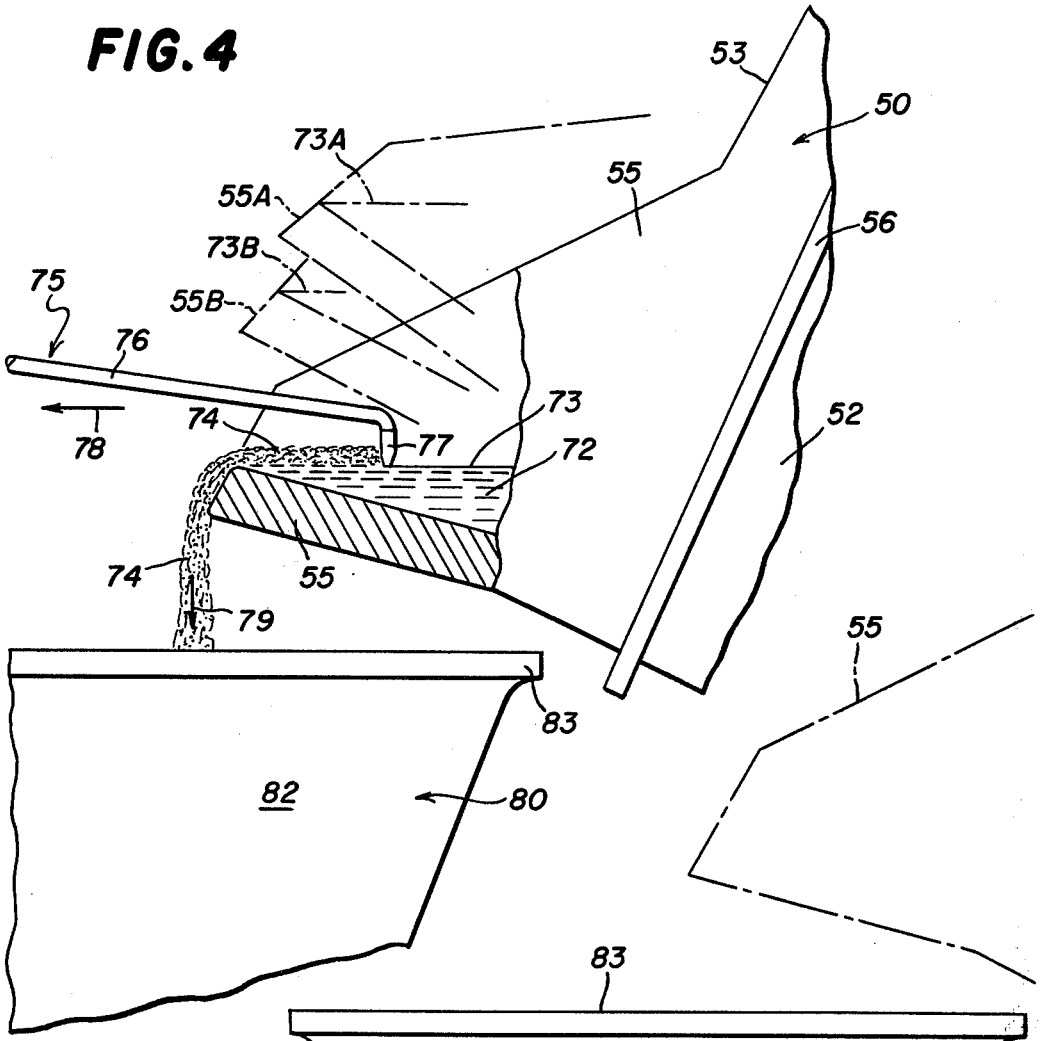
FIG. 4 is a fragmentary view with certain parts broken away of the pouring spout of a ladle showing the minimum tilt posiion in the upper dashed lines and the maximum tilt position in solid lines with an intermediate position also illustrated in dashed lines.

There also is diagrammatically illustrated in FIG. 4 the position in which the ladle 50 is placed when the maximum charge of 510,000 lbs. of hot molten iron is in the ladle 50, this position of the pouring spout being designated by the numeral 55A and the hot metal level being designated 73A. With the ladle 50 filled to this maximum design capacity, the ladle 50 need only be tilted to an angle of 39° with respect to the vertical in order to place the molten slag 74 in a position to be removed by the hydraulic skimming device 75. It will be understood that any position may be assumed between the minimum 39° tilt position of the pouring spout designated by the numeral 55A in FIG. 4 and the maximum tilt position of 60° illustrated by the solid line position of the pouring spout 55 in FIG. 4, one such intermediate position being shown by the dashed line position of the pouring spout 55B with a corresponding hot molten iron level 73B. This position corresponds to a charge of 420,000 lbs. of hot molten iron in the ladle 50 and requires a tilt of 47.5° with respect to the vertical of the ladle 50 in order to place the parts in optimum position to permit the removal of the molten slag layer 74 by the hydraulic skimming device 75.

It will be understood that in each of the positions in FIG. 4 illustrated by dashed lines including the positions 55A and 55B of the pouring spout, the center of gravity of the combined ladle 50 plus its metal content plus the ladle support frame 110 is positioned to the rear or to the right of the vertical plane through the axis of the stub shafts 113 as viewed in FIG. 3A. As a result, gravity will always bias the ladle 50 and the ladle support frame 110 toward the upright position thereof illustrated by solid lines in FIG. 3A. As a consequence, any failure of the hydraulic motors 150 such as an hydraulic failure or an electrical power failure, will result in automatic righting of the frame 110 and the ladle 50 thereon. The rate of return of the ladle 50 and the frame 110 to the upright position will be controlled by the flow of hydraulic fluid through orifice valves (not shown) associated with the two hydraulic motors 150.

After the skimming operation is completed, the hydraulic motors 150 are retracted to move the ladle 50 and the frame 110 from the dashed line positions in FIGS. 3A–3B to the solid line positions thereof. More specifically, the parts are placed in the fully retracted position with the cross member 112 of the ladle support frame 110 abutting against the stop brackets 130. An overhead crane may then be used to engage the trunnions 60, such engagement being facilitated by the fact that the trunnions 60 are positioned well above the support surfaces 121 and free and clear as is best illustrated in FIGS. 1, 2 and 3A. The overhead crane having reengaged the trunnions 60 can then lift the ladle 50 and the hot metal contents thereof to transport them to the next processing station such as a basic oxygen furnace.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A hot metal ladle tilter for controlled tilting of a ladle with a pouring spout and having trunnions extending laterally therefrom on either side of the pouring spout and two support brackets respectively disposed thereon and spaced below the trunnions and an abutment bracket disposed thereon between the pouring spout and the axis of the trunnions, said tilter comprising a support stand having spaced-apart bearings thereon defining a generally horizontal tilt axis, a ladle support frame pivotally mounted on the bearings on said support stand for tilting about the tilt axis, said ladle support frame including two spaced-apart support members each having a support surface for readily removably receiving thereon respectively the support brackets of a ladle to be tilted, each support surface being open at the end thereof away from the ladle pouring spout and being provided adjacent to the opposite end thereof with an upstanding abutment surface for engaging the abutment bracket on a ladle to be tilted and cooperating with said support surface to form a generally L-shaped support seat, the ladle being freely supported on said support seats of said ladle support frame and being maintained thereon solely by gravity and being receivable thereon and removable therefrom in any tilt position of said support frame, and a motor for tilting said ladle support frame with a ladle of hot metal thereon about the tilt axis to lower the pouring spout of the ladle to a predetermined point to permit skimming of the slag from the surface of the hot metal in the ladle.

2. The hot metal ladle tilter as set forth in claim 1, wherein said spaced-apart bearings are spherical bearings.

3. The hot metal ladle tilter as set forth in claim 1, wherein said motor is a hydraulic motor.

4. The hot metal ladle tilter as set forth in claim 1, wherein two spaced-apart motors are provided engaging said ladle support frame at spaced-apart positions to tilt said ladle support frame about the tilt axis.

5. The hot metal ladle tilter as set forth in claim 1, wherein a cover is provided over said motor to protect the same.

6. The hot metal ladle tilter as set forth in claim 1, wherein means is provided for lubricating said bearings during the operation of said ladle tilter.

7. A hot metal ladle tilter for controlled tilting of a ladle with a pouring spout and having trunnions extending laterally therefrom on either side of the pouring spout and two support brackets respectively disposed thereon and spaced below the trunnions and an abutment bracket disposed thereon between the pouring spout and the axis of the trunnions, said tilter comprising a support stand having spaced-apart bearings thereon defining a generally horizontal tilt axis, a ladle support frame pivotally mounted on the bearings on said support stand for tilting about the tilt axis, said ladle support frame including two spaced-apart support members each having a support surface for readily removably receiving thereon respectively the support brackets of a ladle to be tilted, each support surface being open at the end thereof away from the ladle pouring spout and being provided adjacent to the opposite end thereof with an upstanding abutment surface for engaging the abutment bracket on a ladle to be tilted and cooperating with said support surface to form a generally L-shaped support seat, the ladle being freely supported on said support seats of said ladle support frame and being maintained thereon solely by gravity and being receivable thereon and removable therefrom in any tilt position of said support frame, a stop bracket fixedly positioned with respect to said support stand and engaging said ladle support frame when in the ladle receiving position thereof and positively preventing tilting of said ladle support frame and the ladle thereon in a direction rearwardly and away from the pouring spout on the associated ladle, the center of gravity of said ladle support frame and of the combination of said ladle support frame with a ladle thereon being disposed rearwardly with respect to the tilt axis so that said ladle support frame is urged against said stop bracket by gravity, and a motor for tilting said ladle support frame with a ladle of hot metal thereon about the tilt axis to lower the pouring spout of the ladle to a predetermined point to permit skimming of the slag from the surface of the hot metal in the ladle.

8. The hot metal ladle tilter set forth in claim 7, wherein said stop bracket is disposed forwardly with respect to the tilt axis and engages the forward portion of said ladle support frame.

9. The hot metal ladle tilter set forth in claim 7, wherein said ladle support frame is constructed and arranged so that the center of gravity thereof is rearwardly with respect to the tilt axis so that said ladle support frame is urged by gravity to a position contacting said stop bracket so as to position said ladle support frame in a fixed position for receiving a ladle thereon.

10. The hot metal ladle tilter set forth in claim 7, wherein two stop brackets are provided laterally spaced apart and engaging said ladle support frame at laterally spaced-apart points thereon.

11. The hot metal ladle tilter set forth in claim 7, wherein a cushioning and insulating layer is provided on said stop bracket on the portion thereof disposed toward said ladle support frame.

12. A hot metal ladle tilter for controlled tilting of a ladle with a pouring spout and having trunnions extending laterally therefrom on either side of the pouring spout and two support brackets respectively disposed thereon and spaced below the trunnions and an abutment bracket disposed thereon between the pouring spout and the axis of the trunnions, said tilter comprising a support stand having spaced-apart bearings thereon defining a generally horizontal tilt axis, a ladle support frame pivotally mounted on the bearings on said support stand for tilting about the tilt axis, said ladle support frame including two spaced-apart support members each having a support surface for readily removably receiving thereon respectively the support brackets of a ladle to be tilted, each support surface being open at the end thereof away from the ladle pouring spout and being provided adjacent to the opposite end thereof with an upstanding abutment surface for engaging the abutment bracket on a ladle to be tilted and cooperating with said support surface to form a generally L-shaped support seat, the ladle being freely supported on said support seats of said ladle support frame and being maintained thereon solely by gravity and being receivable thereon and removable therefrom in any tilt position of said support frame, a stop bracket fixedly positioned with respect to said support stand and engaging said ladle support frame when in the ladle receiving position thereof and positively preventing tilting of said ladle support frame and the ladle thereon in a direction rearwardly and away from the pouring spout on the associated ladle, the center of gravity of said ladle support frame and of the combination of said ladle support frame with a ladle thereon being disposed rearwardly with respect to the tilt axis so that said ladle support frame is urged against said stop bracket under the urging of gravity, an hydraulic motor having one end pivotally mounted at a fixed point spaced from said ladle support frame and the other end pivotally mounted on said ladle support frame at a point offset from the tilt axis, and control means for actuating said hydraulic motor to tilt said ladle support frame with a ladle of hot metal thereon about the tilt axis and away from said stop bracket to lower the pouring spout of the ladle to a predetermined point to permit skimming of the slag from the surface of the hot metal in the ladle.

13. The hot metal ladle tilter set forth in claim 12, wherein said hydraulic motor is positioned in front of said ladle support frame and is pivoted thereto at a point disposed below the tilt axis, said control means upon actuation expanding said hydraulic motor to cause the desired tilting of said ladle support frame and the ladle of hot metal thereon.

14. The hot metal ladle tilter as set forth in claim 12, wherein two hydraulic motors are provided laterally spaced apart and engaging said ladle support frame at laterally spaced-apart points thereon.

15. The hot metal ladle tilter set forth in claim 12, wherein said hydraulic motor includes mechanism in the hydraulic circuit that slowly permits return of said ladle support frame with the ladle thereon into contact with said stop bracket in the event of loss of power to said hydraulic motor.

* * * * *